US005906434A

United States Patent [19]

Berrios

[11] Patent Number: 5,906,434

[45] **Date of Patent: *May 25, 1999**

[54] ROTATING TRIANGULAR DRUM FOR INCUBATING PROBES WITH MEMBRANE-IMMOBILIZED LIGANDS

[75] Inventor: Miguel Berrios, Stony Brook, N.Y.

[73] Assignee: The Research Foundation of State University of New York at Stony Brook, Stony Brook, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,054

[22] Filed: Jun. 26, 1997

Related U.S. Application Data

[60] Provisional application No. 60/039,394, Feb. 28, 1997.

[51] Int. Cl.[6] ..... B01F 11/00

[52] U.S. Cl. ..... 366/213; 366/214; 366/218; 211/78

[58] Field of Search ..... 366/220, 208, 366/232, 233, 236, 209, 213, 214, 218, 219, 200; 422/104, 65; 211/164, 78

[56] References Cited

U.S. PATENT DOCUMENTS

| | | | |
|---|---|---|---|
| 621,563 | 3/1899 | Gilbert | 366/214 |
| 755,216 | 3/1904 | Carrier | 366/214 |
| 1,830,828 | 11/1931 | Eaton | 211/164 |
| 2,936,901 | 5/1960 | Siemantel | 211/164 |
| 3,231,244 | 1/1966 | Moody et al. | 366/214 |
| 4,301,718 | 11/1981 | Lewinger et al. | 366/214 |
| 4,712,693 | 12/1987 | Striplin | 211/164 |
| 5,047,210 | 9/1991 | Melet | 211/78 |
| 5,531,332 | 7/1996 | Monnens | 211/164 |

FOREIGN PATENT DOCUMENTS

| | | | |
|---|---|---|---|
| 2340703 | 2/1976 | France | 211/164 |
| 712410 | 7/1954 | United Kingdom | 211/164 |

*Primary Examiner*—Tony G. Soohoo
*Attorney, Agent, or Firm*—Ostrolenk, Faber, Gerb & Soffen, LLP

[57] ABSTRACT

A rotator for agitating materials disposed within a sealed container includes a base having opposite ends, first and second opposite spaced apart side portions extend up from the base, a substantially triangular shaped drum having first, second and third side surfaces, a pair of opposing end surfaces, and a central axis passing through the end surfaces. At least one side surface receives the sealed container. The drum is rotatably coupled to the side portions and is rotatable about the central axis.

7 Claims, 2 Drawing Sheets

ROTATING TRIANGULAR DRUM FOR INCUBATING PROBES WITH MEMBRANE-IMMOBILIZED LIGANDS

CROSS REFERENCE TO RELATED APPLICATIONS

This application is based on and claims priority to U.S. Provisional patent application No. 60/039,394, filed Feb. 28, 1997, entitled A ROTATING TRIANGULAR DRUM FOR INCUBATING PROBES WITH MEMBRANE-IMMOBILIZED LIGANDS.

BACKGROUND

1. Field of the Invention

The present invention relates to rotators for mixing materials for incubation and, more particularly, to rotators and shakers capable of receiving sealed bags containing, for example, membrane blots.

2. Related Art

Membrane-based assays are used for the analysis of nucleic acid and/or protein samples. These membrane based assays are called "membrane blots" or simply "blots" and include immuno blots (Western blots), Southern, and Northern blots. These blots are either stained with a specific dye and/or probed with antibody and/or nucleic acid probes. In order to successfully probe a blot, the blot must be agitated prior to incubation.

More specifically, blots are made by transferring electrophoretically separated protein and nucleic acid mixtures onto membranes with high binding capacity such as nitrocellulose or Immobilon-P (by Dupont). After proteins and/or nucleic acids are transferred from the gel matrix to a membrane, the blot is an exact replica of the original electrophoretogram. The blot is then either stained with a specific dye and/or probed with antibody and/or nucleic acid probes.

Practically speaking, probing a membrane blot involves placing the membrane into a sealable plastic bag (like a Seal-a-Meal™ bag) which is filled with a probe diluted in an incubation buffer. The bags are heat sealed before incubation and washing. The sealed bags containing blots soaking in an incubation mixture usually then require regular shaking (agitation) to assure even exposure of the membrane to the probe and to diminish unspecific binding of the probe to the membrane.

Agitation is usually accomplished by gently shaking the bag every few minutes or by placing the bags on a mechanical shaker or rotator. Unfortunately, prior art rotators and shakers are unsatisfactory for receiving the relatively large and flexible plastic bags containing blots. Indeed, prior art rotators and/or shakers are specifically designed for receiving test tubes for agitation, not blots.

Accordingly, there is a need in the art for a new rotator and shaker which is capable of receiving and agitating a blot for incubation which does not suffer from the disadvantages of the prior art designs.

SUMMARY OF THE INVENTION

In order to overcome the disadvantages of the prior art, the rotator and shaker of the present invention includes a base having opposite ends and first and second opposite side portions extending from respective opposite ends of the base. A substantially triangular cross-section drum has first, second and third flat rectangular side surfaces, opposite end surfaces, and a central axis passing through the end surfaces. The drum is rotatably coupled to the opposite side portions of the base and is rotatable about the central axis. At least one side surface receives a sealed container.

Other features and advantages of the present invention will become apparent from the following description of the invention which refers to the accompanying drawings.

DETAILED DESCRIPTION OF THE PREFERRED EMBODIMENT

Figure 1:
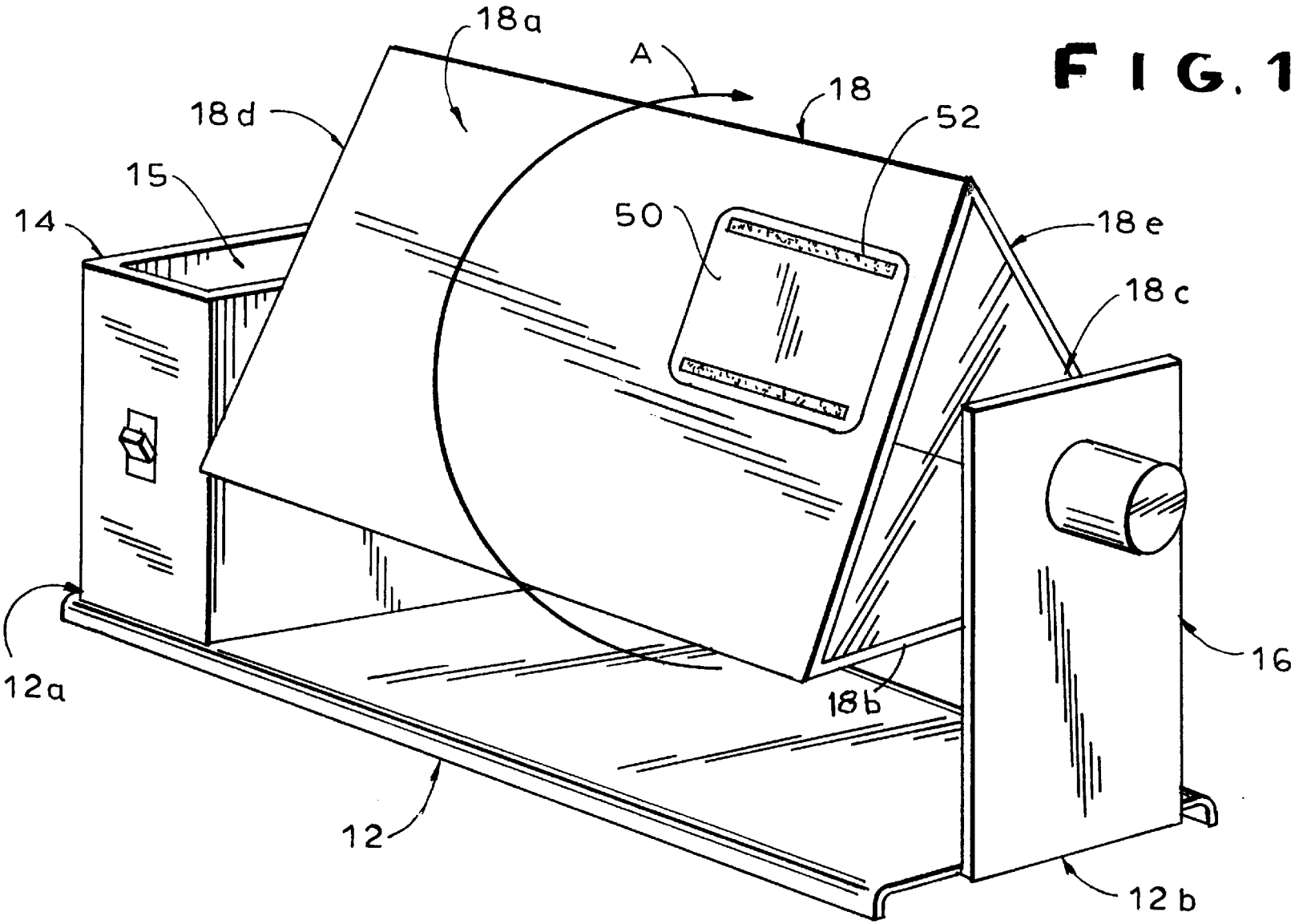
FIG. 1 is a perspective view of the rotator of the preferred embodiment of the present invention.

FIG. 1 shows a rotator 10 (or a shaker) in accordance with the preferred embodiment of the present invention. The rotator 10 includes a base 12 of generally rectangular design having opposite ends 12*a,* 12*b.* Side portions 14 and 16 are coupled to the ends 12*a* and 12*b,* respectively, and extend substantially perpendicularly up from the base 12. A drum 18 with triangular cross section and having side surfaces 18*a,* 18*b,* 18*c* and two opposite end surfaces 18*d,* 18*e* is disposed between the side portions 14, 16. It is preferred that the drum 18 have a substantially triangular cross section, where the end surfaces are equilateral triangles. The drum 18 is rotatably coupled to the side portions 14, 16 along a central axis of the drum 18 such that the drum 18 is rotatable about the central axis.

Preferably, the side portion 14 includes a housing 15 which contains a motor (not shown) for rotating the drum 18 in the direction of the arrow A. The motor preferably rotates the drum 18 at about 12 RPM. A commercially available hematology/chemistry mixer having a motorized base 12 which may be adapted for use with the present invention may be obtained from Fisher Scientific, Inc., Pittsburgh Penn. (Cat. No. 14-059-346).

Referring to FIGS. 1, and 2*a*–2*c,* each side surface 18*a,* 18*b,* and 18*c* of the drum 18 provides a relatively large flat surface for receiving one or more flexible containers (for example, plastic bags containing blots, not shown). The containers (for example blot bags 50) may be fastened to the side surfaces of the drum 18) by way of small permanent magnets, adhesives, self sticking tape, or the like, generally designated by reference designator 52. This form of bag attachment to the drum facilitates their rapid removal and reattachment during incubations.

Figures 2A, 2B, 2C:
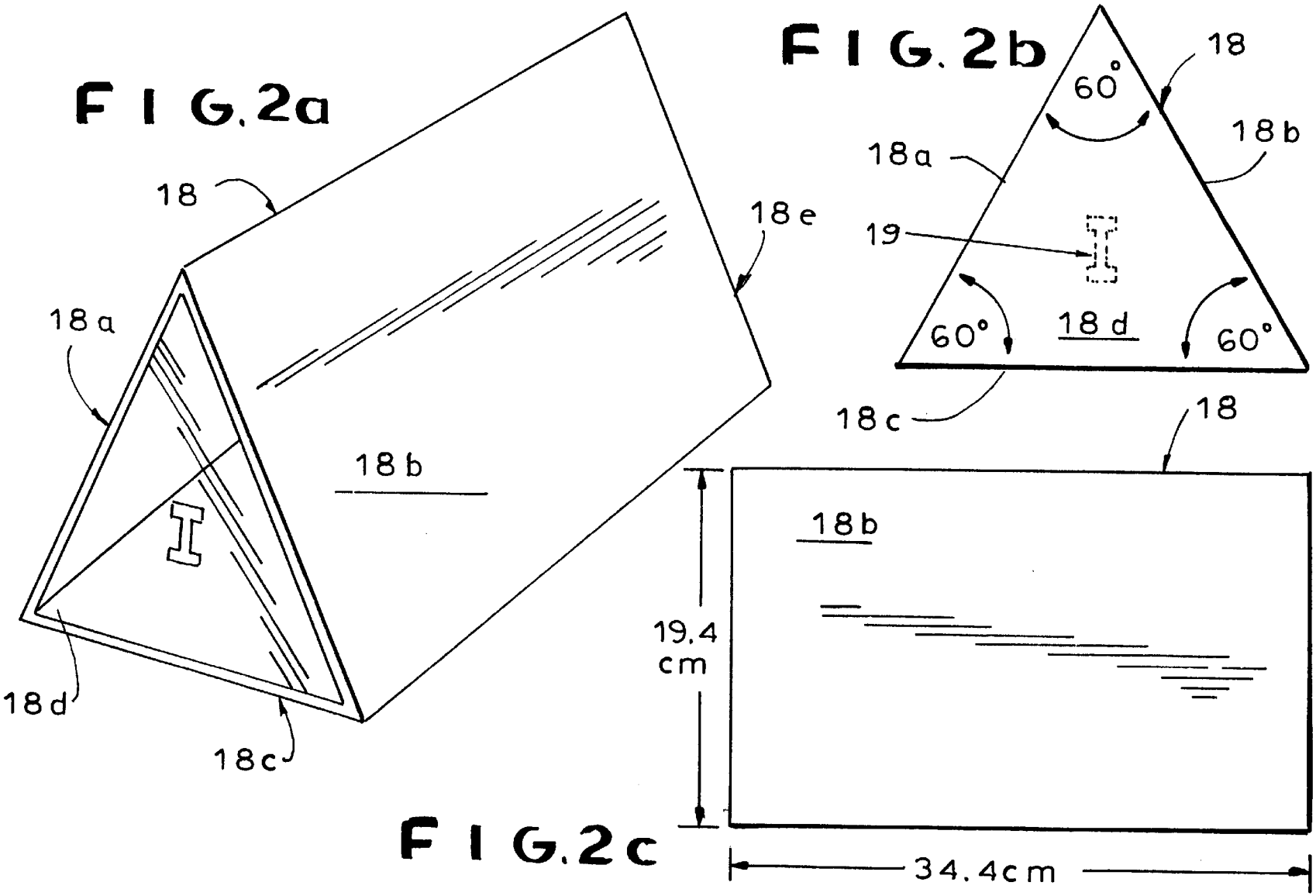
FIGS. 2*a,* 2*b* and 2*c* show a perspective view, an end view, and a side view of the drum of the rotator of FIG. 1.

Referring to FIG. 2*b,* the drum 18 preferably has an equilateral triangle shape when viewed from each end. Other drum shapes tested, such as cylindrical drums or square drums, resulted either in poor exposure of the membranes to the buffer or have a limited flat surface for relatively large blots.

The drum 18 also includes a key or notch 19 in each end surfaces 18*d,* 18*e* for engaging a shaft, or the like, which facilitates rotation of the drum 18. The side surfaces 18*a,* 18*b,* 18*c* of the triangular drum 18 may be formed of any suitable material, with a 9 mm thick, clear acrylic plastic (for example, Lucite™) being preferred for the two end surfaces 18*d,* 18*e.* When magnets 52 are used, the side surface to which the magnet 52 is to attach should be formed with a magnetically attractable material. It is also preferred that the side surfaces be about 19.4 cm wide and about 34.4 cm long. It has been found that the drum 18 provides excellent performance when each side surface has an area of about 667 $cm^2$ (totalling nearly 2000 $cm^2$ of available flat surface area), although it is understood that the specific dimensions given are not intended to be restrictive. The drum 18 described above weighs about 1.5 Kg.

Advantageously, the rotator 10 of the present invention provides complete soaking of a plurality of membrane blots (including large blots) by the incubation buffer by providing a large surface area for accepting the blots and subjecting the blots to agitation. The above described rotator 10 is of low cost and is easily fabricated.

The foregoing description of the preferred embodiment of the present invention has been provided for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A rotator, comprising:

a base;

first and second opposite side portions extending up from the base;

a substantially triangular shaped drum having first, second and third outside surfaces, a pair of opposite end surfaces, and a central axis passing through the end surfaces;

at least one blot bag for placement on the outside surface of the drum; and fastening means disposed on the blot bag or the outside surface of the drum for attaching the blot bag to at least one outside surface of the drum;

the drum being rotatably coupled to the opposite side portions of the base and rotatable about the central axis.

2. The rotator of claim 1, wherein the base includes a motor coupled to the drum for rotating the drum about the central axis.

3. The rotator of claim 2, wherein the motor rotates the drum about the axis at about 12 RPM.

4. The rotator of claim 1, wherein the fastening means includes magnets for coupling the blot bag to the at least one side surface.

5. The rotator of claim 1, wherein the fastening means includes an adhesive layer for coupling the blot bag to the at least one outside surface.

6. The rotator of claim 1, wherein the first, second and third outside surfaces are about 34 cm long and about 19 cm wide.

7. The rotator of claim 1, wherein the opposite end surfaces are formed of an acrylic material.

* * * * *